United States Patent [19]

Nishide et al.

[11] Patent Number: 4,927,725

[45] Date of Patent: May 22, 1990

[54] ELECTROPHOTOGRAPHIC METHOD

[75] Inventors: Hiroo Nishide; Shintaro Kaneko, both of Kanagawa, Japan

[73] Assignee: Fuji Xerox Co., Ltd., Tokyo, Japan

[21] Appl. No.: 281,375

[22] Filed: Dec. 8, 1983

[30] Foreign Application Priority Data

Dec. 14, 1987 [JP] Japan ..... 62-316853

[51] Int. Cl.[5] ..... G03G 13/01; G03G 13/22

[52] U.S. Cl. ..... 430/54; 430/42; 430/47

[58] Field of Search ..... 430/42, 44, 54, 47

[56] References Cited

U.S. PATENT DOCUMENTS 2,868,642 1/1955 Hayford et al. ..... 430/54

*Primary Examiner*—Paul R. Michl

*Assistant Examiner*—Jeffrey A. Lindeman

*Attorney, Agent, or Firm*—Finnegan, Henderson, Farabow, Garrett and Dunner

[57] ABSTRACT

A method of making a reproduction copy of an image or a document by electrophotography wherein high print density portions of an original image are developed and transferred onto a recording medium before low print density portions of the original image are developed and transferred onto the recording medium. The original image is multiply scanned under successive, controlled conditions to produce a series of latent images, each of which represents a print density component of the original image. Each latent image is developed and transferred onto the recording medium to produce a composite print density and gradation which closely approaches the print density and gradation of the original document or a predetermined density and gradation.

3 Claims, 5 Drawing Sheets

ELECTROPHOTOGRAPHIC METHOD

BACKGROUND OF THE INVENTION

1. Field of the Invention

The present invention relates to a method of improving the gradation, contrast and resolution of images and pictures obtained by electrophotography.

2. Description of the Prior Art

In conventional, electrophotographic copying machines, the entire cycle of a series of steps and operations performed in order to generate an electrophotographic reproduction of an image or picture, including the steps of exposure, development and transfer, occurs during one rotation cycle of an electrophotographic drum which has a photoreceptor surface layer to capture the image or picture being reproduced. Accordingly, the print density of the electrophotographic reproduction or copy obtained using conventional electrophotographic copying machines and the print density of the original image or document may be compared to determine the effectiveness and accuracy of the electrophotographic copying machine. In FIG. 6, solid line A illustrates the relationship of the print density of a copy as a non-linear function of the print density of the original document in conventional, electrophotographic copying machines. Solid line A illustrates the characteristic initial steep slope at the lower print density region and the flattening slope of saturation at the higher print density region. The relationship exhibited by solid line A is caused by various factors such as the developing agent and the sensitivity of the photoreceptor layer on the electrophotographic drum. In most instances, a document to be electrophotographically reproduced comprises only text and/or simple outline graphics and therefore has only two print densities—black and white, and the characteristic non-linear relationship (as shown by line A in FIG. 6) is not a serious problem.

In the case of documents such as photographs which have varying gradation and shading and changing print densities which merge in continuous fashion, the characteristic non-linear relationship (as shown by line A in FIG. 6) negatively impacts and deteriorates the gradation, contrast, resolution, print density and general quality of the reproduced copy relative to the gradation, contrast, resolution, print density and general quality of the original document. Accordingly, in reproducing documents having varying gradation and shading with changing print densities such as photographs, it is desirable to achieve a reproduction copy print density which is directly proportional to the print density of the original document. The relationship between the print density of the reproduction copy and the print density of the original document is, therefore, preferably a linear function as illustrated by the dotted line B in FIG. 6.

Previous attempts to achieve improved gradation, contrast and resolution in electrophotographically reproduced images may be seen in U.S. Pat. No. 2,868,642; in Japanese Patent Publication No. 48-17335; and in an article by Suzuki in the "Journal of Electrophotographic Society, " Vol. 25, No. 1, pp. 52–58 (1986). These prior art methods employ electrophotographic copying methods in which the various parameters affecting the formation of a latent image are altered and modified in relationship with changes in print density of the original document to produce multiple latent images which represent different print densities of the original document. The latent images thus obtained are then developed and transferred onto the recording media in a superimposed manner to generate a reproduction copy of the original document.

In these previous attempts, a first step comprises forming a latent image under conditions optimal for the reproduction of lower print density portions of the original document, and thereafter transferring the image onto paper to reproduce the lower density portions of the original document. The second step comprises forming latent images under conditions optimal for the reproduction of higher print density portions of the original document, and thereafter successively transferring the latent image in a superimposed manner onto the same paper in order to reproduce the original document with relatively high gradation and contrast By "higher print density," reference is made to increased developing bias for a higher exposure parameter to the photoreceptor drum so as to produce a latent image comprising only the high print density portion of the original document. Similarly, by the term "lower density," reference is made to a low developing bias for a lower exposure factor to the photoreceptor drum so as to produce a latent image comprising a lower print density portion of the original document including a portion of the higher print density portions as well.

The above-mentioned prior art methods, however, suffer from a common problem in that it is difficult to obtain a desired print gradation and contrast since an image of a lower print density portion is first formed after which higher print density images are formed in superimposed fashion. The problem of this approach will be described with reference to FIGS. 7(*a*)–7(*e*). FIG. 7(*a*) is a schematic diagram in which the photoreceptor 20, toner, paper P and a transfer drum 32 are shown. In normal use, although the photoreceptor 20 and the developing drum 32 are in contact with each other with paper P interposed between them, for the purpose of facilitating explanation and description, the photoreceptor 20 and the developing drum 32 are shown apart from each other with the paper P on the developing drum 32.

Referring to FIGS. 7(*a*)–7(*e*), if lower print density portion reproduction is performed first, an image $T_L$ of the lower print density portion is formed on the photoreceptor 20 as shown in FIG. 7(*a*). This image $T_L$ is transferred by means of a transfer electric field onto paper P disposed on a transfer drum 32, as shown in FIG. 7(*b*). Next, a higher print density portion reproduction is performed to form a latent image $T_H$ of the higher print density portion on the photoreceptor 20 as shown in FIG. 7(*c*). The image or picture area of the image $T_L$ of the lower print density portion is larger than that of the image $T_L$ of the higher density portion. This is due to the fact that while the image of the entire, original document from the higher print density portions (highlight portion) to the lower print density portions (shadow portion) is continuously formed during lower print density portion reproduction, only an image with print density higher than a predetermined print density is reproduced in the higher print density portion reproduction.

No problem is presented if the image $T_H$ of the higher print density portion is transferred perfectly over the image $T_L$ of the lower print density portion in a superimposed manner as shown in FIG. 7(*d*). However, as in the usual case, a considerable quantity of toner in the portion of a lower print density portion image area, except the higher print density portion image area being transferred, is transferred back from the paper P to the photoreceptor 20 due to a so-called retransfer of toner as shown in FIG. 7(*e*). The problem which results is that the lower print density portion reproduction is not performed satisfactorily.

The reason why such retransfer of toner occurs may be explained with reference to FIG. 8. FIG. 8 is a schematic diagram illustrating for representation purpose only the toner retransfer phenomenon.

In FIG. 8, toner T adhering onto the photoreceptor 20 through development is transferred to paper P which is adsorbed on a transfer drum 32. Although the toner T (assumed to be negatively charged) sandwiched between the paper P and the photoreceptor 20 receives a sufficient transfer of electrical force to transfer the toner toward the paper P, the toner on the surface of the photoreceptor 20 suffers from a counter force which prevents transfer of the toner from the surface of the photoreceptor 20 to the paper P due to an adhesion force produced on the surface of the photoreceptor 20—mainly mirror forces and Van der Waals forces. Thus, in the usual transfer of toner, if there is a thick layer or a large quantity of toner T on the surface of the photoreceptor 20, the toner T is in a stacked configuration on the photoreceptor 20 as shown in FIG. 8, and most of the toner T (80% to 90%) is transferred to the paper P while toner T*a* in direct contact with the surface of the photoreceptor 20 is not transferred. However, if there is a thin layer or only a small amount of toner on the photoreceptor 20, most of the toner is in direct contact with the surface of the photoreceptor 20. As previously noted, since the toner in contact with the surface of the photoreceptor 20 is not easily transferred onto the paper P due to the adhesive forces produced on the surface of the photoreceptor 20, the amount of toner transferred, that is, the transfer efficiency, is lowered to 30% to 40%, as shown in FIG. 9.

In multiple transfer, therefore, if lower print density portion reproduction is performed first, toner adhering to paper P is sandwiched between the paper P and the photoreceptor 20 again, so that the toner is transferred to the photoreceptor 20 and thereby causes the toner retransfer problem.

Based upon the toner retransfer problem, the relationship between the print density of an image obtained in practice by composition of images using multiple transfer and the print density of the original is illustrated by the solid line C in FIG. 10. The characteristics of line C is different from the characteristics of line D added on calculation as shown by the broken line. The ideal density characteristic is shown as dotted line E. It is apparent from FIG. 10 that previous attempts at improving the gradation and quality of images by multiple transfer of latent images has not altogether been successful.

Since the amount of toner transferred by retransfer varies erratically with changes in environmental operating conditions, an additional problem exists in that the desired picture quality cannot be obtained through superimposition of the latent images even if adjustments in lower and higher print density portions are independently made relative to each other, and therefore the difficulties associated with adjusting both the lower and higher print density portions are appreciated.

SUMMARY OF THE INVENTION

The present invention overcomes the problems and disadvantages of the prior art by providing a novel method of making electrophotographic reproductions having improved gradation, contrast and resolution. The present invention represents a vast improvement and a completely novel approach for satisfying and meeting the needs, requirements and criteria for effective and useful improvements in electrophotographic copying techniques in a cost-effective manner.

It is an object of the present invention to provide a method of making electrophotographic reproductions using multiple transfer of images wherein the higher print density portions are reproduced before the reproduction of lower print density portions so as to improve the print gradation and quality of the image or picture of the copy thus obtained.

Additional objects and advantages of the present invention will be set forth, in part, in the description which follows and, in part, will be obvious from the description or may be learned by practice of the invention. The objects and advantages of the invention may be learned by and attained by means of the instrumentalities and combination of steps particularly pointed out in the appending claims.

To achieve the foregoing objects and in accordance with the purpose of the present invention, as embodied and broadly described herein, the method of making electrophotographic reproductions of an original document according to the present invention comprises the steps of: forming a first image of a document to be reproduced with latent image forming parameters made suitable for higher print density portion reproduction; transferring the first image onto paper; forming a second image of the same document with latent image forming parameters made suitable for lower print density portion reproduction; and transferring the second image onto the same paper so that the second image is superimposed over the first image.

According to the present invention, the higher print density portion reproduction is performed first in multiple transfer. During higher print density portion reproduction, the range of print density to be developed is narrow and therefore the total area of the higher print density image is smaller than the total area of the entire document image. Accordingly, the total area of the higher print density latent image on the photoreceptor can be relatively small, and it is this relatively small latent image area which represents the higher print density portions of the document to be reproduced and which is developed by toner and then transferred onto the recording paper. After transfer of the higher print density portions onto the paper, the lower print density portion reproduction is performed. When the image obtained in the lower print density portion reproduction is sandwiched between the drum-shaped photoreceptor and the paper, there may already exist toner which has been developed since the image area of the lower print density portion is relatively large. Since only the higher print density portions have been transferred onto the paper, the probability of toner retransfer from the paper in the lower print density regions is relatively small, and therefore, the problem of toner retransfer becomes largely eliminated.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENT

Reference will now be made, in detail, to a preferred embodiment of the present invention, an example of which is illustrated in the accompanying drawings. Whenever possible, the same reference numbers will be used throughout the drawings to refer to the same or like parts.

Figure 2:
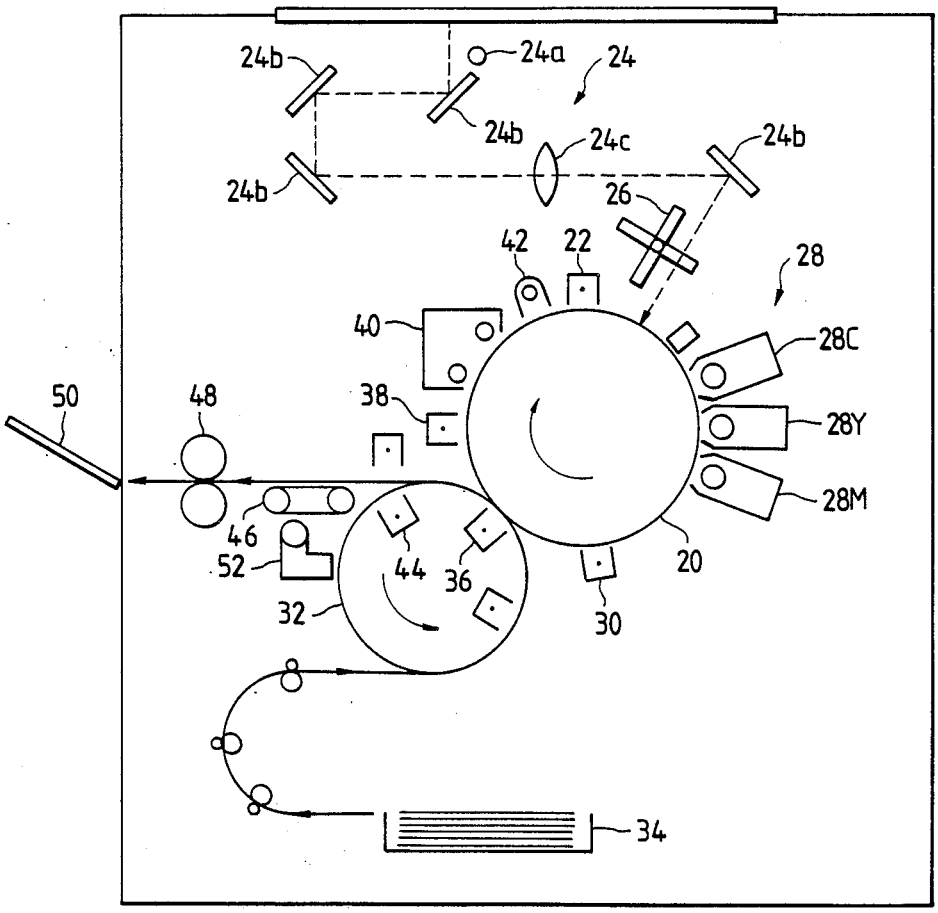
FIG. 2 is a schematic, sectional view of a color, electrophotographic copying machine which may be used in conjunction with the method of the present invention.
Figure 5A:
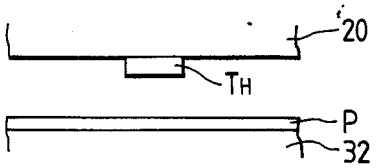
FIGS. 5(*a*)–5(*d*) are a series of schematic diagrams illustrating the principle of multiple transfer according to the present invention.
Figure 5B:
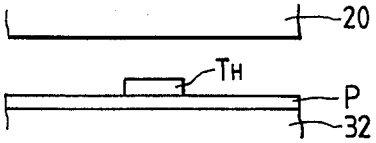
Figure 5C:
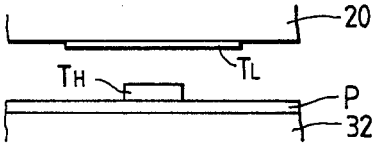
Figure 5D:
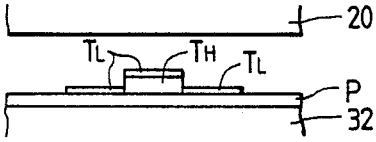
Figure 6:
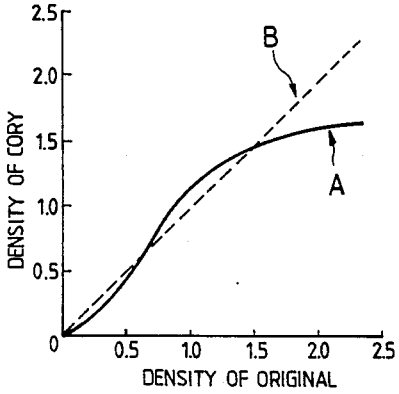
FIG. 6 is a graph illustrating a print density characteristic of a copy obtained using a conventional, electrophotographic method.
Figure 7A:
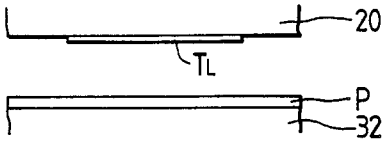
FIGS. 7(*a*)–7(*e*) are a series of diagrams illustrating the principle of multiple transfer and toner retransfer according to a conventional method of electrophotographic reproduction.
Figure 7B:
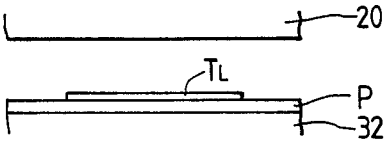
Figure 7C:
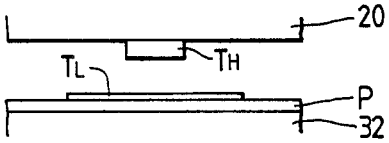
Figure 7D:
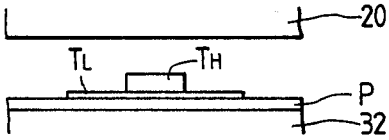
Figure 7E:
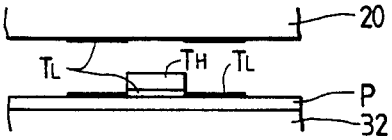
Figure 8:
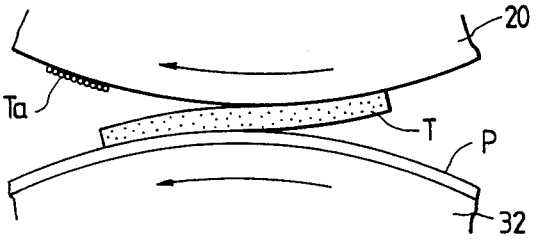
FIG. 8 is a schematic diagram explaining the toner retransfer phenomenon.
Figure 9:
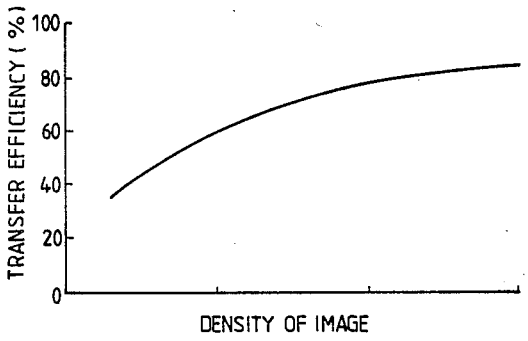
FIG. 9 is a graph illustrating the transfer efficiency of toner from the photoreceptor layer on the electrophotographic drum to the paper.

In FIG. 2, a drum-shaped photoreceptor 20 is arranged to rotate in the direction of the arrow. The photoreceptor 20 is charged to a predetermined potential by a charging corotron 22 and exposed to light which carries the image of an original document (not shown) by means of a scanning optical system 24 comprising light source 24*a*, mirror 24*b*, and lens 24*c*, in order to form a latent image on the photoreceptor 20. An interchangeably mounted color separation filter 26 is provided in the light path of the original image carrying light. The color separation filter 26 is interchanged every time scanning on the original document is performed by the scanning optical system 24, so that latent images corresponding to respective colors, for example, red, green and blue, are formed sequentially on the photoreceptor 20. Downstream of the exposure area on the photoreceptor 20, developing devices 28C, 28Y and 28M are disposed so as to be selectively operable in synchrony with the formation of each latent image of each respective color. The latent images of each respective color on the photoreceptor 20 are developed sequentially with corresponding color toner by selective operation of the developing devices 28C, 28Y and 28M. A pre-transfer corotron 30 is disposed downstream of the developing device 28 but upstream of the transfer corotron 36.

Synchronously with the rotation of the drum-shaped photoreceptor 20, paper is fed from a paper feed tray 34, adsorbed onto the surface of the transfer drum 32 and carried toward the photoreceptor 20. Then, at the position where the photoreceptor 20 and the transfer drum 32 are in contact with each other, the toner image is transferred to the paper by transfer corotron 36. The paper, after the first transfer, remains adsorbed on the surface of the transfer drum 32 and is rotated to come into pressure-contact with the photoreceptor 20 again, so that the toner image of the next color is transferred onto the paper superimposed over the first image layer. Any residual toner on the photoreceptor 20 is subject to charge elimination by a pre-clean corotron 38 after which the residual toner is removed by cleaner 40. Additionally, any residual charge on the photoreceptor 20 is removed by a charge elimination lamp 42.

The paper to which the images of the three colors have been transferred is separated from the transfer drum 32 by a separating corotron 44 and conveyed to fixing means 48 by a conveyer 46 and, after fixing, discharged into a discharge tray 50 provided outside the copying machine. A cleaner 52 is provided downstream of the separating corotron 44 for cleaning the transfer drum 32.

In the above-described color electrophotographic copying machine, the order of operation may be summarized as follows:

(1) Exposure is made with original-image carrying blue light, development is made with yellow toner, and the yellow toner image is transferred onto the paper on the transfer drum 32.

(2) Exposure is made with original-image carrying green light, development is made with magenta toner, and the magenta toner image is transferred onto the yellow toner image on the paper on the transfer drum 32.

(3) Exposure is made with original-image carrying red light, development is made with cyan toner, and the cyan toner image is transferred onto the magenta toner image on the paper on the transfer drum 32.

(4) The paper on which the three color toner images have been transferred in superimposed fashion is separated from the transfer drum 32 and carried to a fixing means 48.

(5) The respective color toner images on the paper are fixed.

It is to be understood that the order of forming each color component as set forth above is but an example and is not to be construed as limiting or otherwise narrowing the scope of the present invention.

Figure 3:
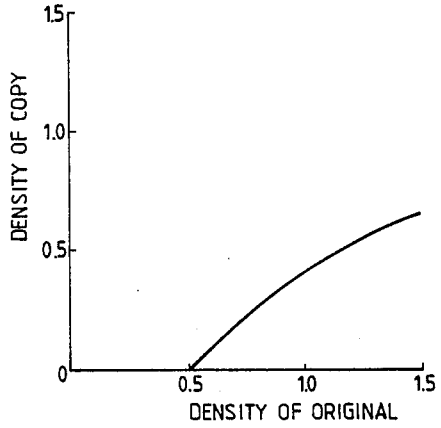
FIG. 3 is a graph illustrating a print density characteristic of a copy obtained using the electrophotographic method of the present invention in which only the higher print density portion of a document is reproduced.
Figure 4:
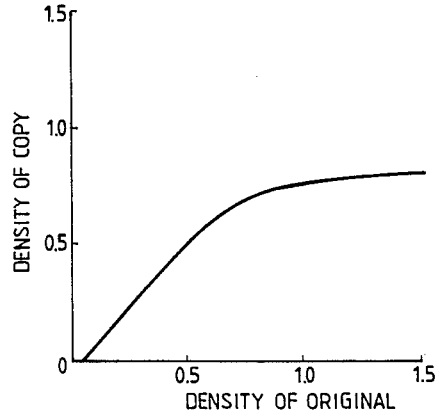
FIG. 4 is a graph illustrating a print density characteristic of a copy obtained using the electrophotographic method of the present invention in which only the lower print density portion of a document is reproduced.

In the above example, the steps of charging, exposing and developing each color component is repeated twice with the latent image forming parameters adjusted each time in order to first perform higher print density reproduction as shown in FIG. 3 and thereafter perform the lower print density reproduction as shown in FIG. 4 for each color component.

Higher print density portion reproduction may be realized by increasing the degree of exposure as well as by increasing the developing bias such that the characteristics as shown in FIG. 3 is realized. Lower print density portion reproduction may be realized by decreasing the degree of exposure as well as by decreasing the developing bias such that the characteristics as shown in FIG. 4 is realized.

During higher print density portion reproduction, the range of print density to be developed is relatively narrow, and therefore, the image area $T_H$ of the higher print density portion is relatively small as shown in FIG. 5(*a*). This relatively small higher print density image $T_H$ is the image that is first transferred from the photoreceptor 1 to the paper P. Following the higher print density transfer, lower print density portion reproduction is performed. When the image $T_L$ of a lower print density portion obtained during lower density portion reproduction is put between the photoreceptor 1 and the paper P, since the image area $T_L$ of the lower density portion is relatively larqe, there may already exist toner which has been developed. Prior to the transfer of the lower print density image onto the paper, only toner transferred during the higher print density portion reproduction is on the paper. Therefore, the probability of toner retransfer from the paper in the lower print density regions is relatively small, and thus, the problem of toner retransfer becomes largely eliminated. Accordingly, as shown in FIG. 5(*d*), most of the toner forming the lower print density image on the photoreceptor is transferred onto the paper. The (superimposed) composite print density of the reproduction copy obtained according to the present invention closely approximates the projected print density calculated using the print density values of each color component.

In the following example, the conditions under which the reproduction of higher and lower print density portions may be carried out according to the present invention will be described with reference to specific values accorded to each parameter.

The photoreceptor 1 as used in an embodiment of the present invention comprises an Al base on which Se is deposited. The photoreceptor is preferably drum-shaped with a diameter of 200 mm. The developing device 5 used in the present invention may comprise a developing roller having a diameter of 50 mm and a developing agent having two components. The method of the present invention was performed at a processing speed of 160 mm/s.

In a conventional color electrophotographic copying machine, a full color image is formed through three revolutions of a drum-shaped photoreceptor with the charged potential of the cyan developer 5C set at 1100 V, the yellow developer 5Y set at 1000 V, and the magenta developer 5M set at 900 V. The developing bias for the cyan developer 5C is 480 V, 420 V for the yellow developer, and 360 for the magenta developer. Developing bias is 480 V for cyan, 420 V for yellow, and 360 V for magenta.

In a preferred embodiment of the present invention, the conditions for lower print density portion reproduction are established as follows. The charged potential of the cyan developer 5C is set at 630 V, the yellow developer 5Y set at 550V, and the magenta developer 5M set at 470 V. The developing bias for the cyan developer 5C is set to 280 V, the yellow developer 5Y set at 230 V, and the magenta developer set at 180 V. Additionally, the degree of exposure is set to approximately only 50% of the degree of exposure in conventional electrophotographic copying machines, e.g., by lowering the voltage applied to the light source 24*a*.

As for higher print density portion reproduction in the preferred embodiment of the present invention, the conditions are established as follows. The charged potentials of each developer are set to the same values as during the lower print density portion reproduction. The developing bias is set to 310 V for cyan, 255 V for yellow, and 200 V for magenta, i.e., the developing bias of each color component during higher print density reproduction is increased over the developing bias of the corresponding color component during lower print density reproduction. Additionally, the degree of exposure is set to approximately 150% of the degree of exposure in conventional electrophotographic copying machines, e.g., by increasing the voltage applied to the light source 24*a*.

Under these conditions, by using a gradation chart having a uniform step-by-step progression of print density values from black to white and after adjusting the gray balance to be suitable with the setting of lower print density portion reproduction, the latent image of each color component is developed and transferred onto the paper in the order of yellow, magenta and cyan. FIG. 4 illustrates the relationship between the print density of a reproduction copy and the print density of the corresponding original document.

FIG. 3 illustrates the relationship between the print density of a higher print density portion reproduction copy relative to the print density of the corresponding original document.

Figure 10:
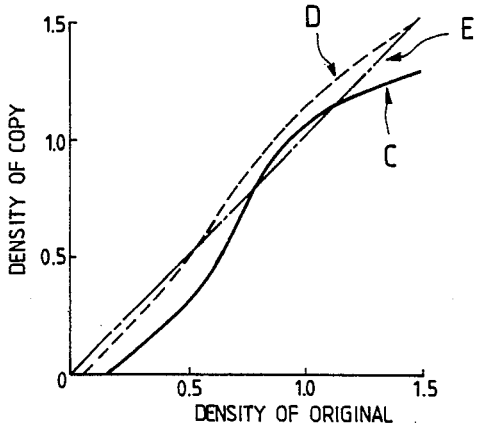
FIG. 10 is a graph illustrating an example of a print density characteristic of a copy obtained using a conventional multiple transfer method in which the higher print density portion reproduction is performed after the lower print density portion reproduction.

In FIG. 10, reference letter D represents the projected print density and reference letter C represent the actual print density characteristic of a conventional electrophotographic copying machine. In a conventional electrophotographic copying machine where the lower print density portion reproduction is performed prior to the higher print density portion reproduction, the characteristics of the lower to middle print density of the reproduction copy is relatively low in comparison with the projected print density characteristic obtained by adding the print density of each component. As to hue, the hue of the lower to middle print density is reddish comparatively with the higher print density portion, and therefor, the gray scale balance is broken, i.e., there was a high rate of cyan retransfer.

In the present example, however, under the conditions as described above, a higher print density portion reproduction is first made and thereafter a lower print density portion reproduction is made and superimposed over the higher print density layer. The print density characteristics of the reproduction copy made in accordance with the present invention is shown as line F in FIG. 1 which is a close approximation of the print density of line G in FIG. 1, obtained by adding the print density of each component. By adjusting the characteristics of electrophotographic reproduction of higher and lower print density portions so that the added (calculated) density becomes an ideal characteristic line E in FIG. 1, it is possible to realize a print density characteristic which closely approximates the ideal print density characteristic. Further, gray balance is kept over the lower to higher print density portions without being broken, i.e., an accurate hue can be reproduced irrespective of the print density of a picture.

Figure 1:
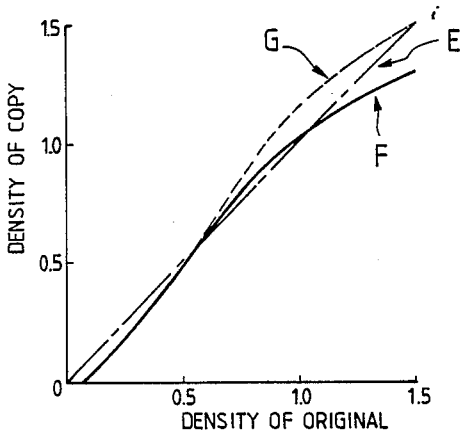
FIG. 1 is a graph illustrating and comparing an example of a print density characteristic obtained using the electrophotographic method of the present invention in which the lower print density portion reproduction is performed after the higher print density portion reproduction.

As can be seen in FIG. 1, the print density of the reproduction copy (line F) as compared with the composite print density of each color component (line G) begins to decrease after approximately the 0.5 level of print density. The reason for this effect is that toner piles up in the higher print density portion of the reproduction copy, and the relationship between the total image area and the amount of toner becomes non-linear and falls into a state of toner saturation.

In an alternate embodiment, the sequential order for transfer of developed images onto paper for color reproduction is yellow higher print density portion transfer, magenta higher print density portion transfer, cyan higher print density portion transfer, yellow lower print density portion transfer, magenta lower print density portion transfer and cyan lower print density portion transfer in order to obtain a color reproduction having superior gradation. In color reproductions, if print density characteristics of respective color components are not even, changes in hue would tend to deteriorate the gradation and overall quality of the reproduction. Accordingly, it is important to keep the print density characteristics of each color component even and in linear form.

In the method of the present invention, the separation of each color component is not limited to two print densities and may be three or more print densities as dictated by the needs of the particular application or as dictated by choice. Accordingly, the number of times a color component is transferred onto the paper may be greater than two depending on the needs of the particular application or based upon preference.

As described above, since the higher print density portion reproduction is performed before the lower print density portion reproduction, it is possible to alleviate the problem of toner retransfer from the recording paper to the surface of the photoreceptor where the developed image resides prior to transfer. Therefore, even in multiple transfer of developed images from photoreceptor to paper, the desired print gradation and quality of a reproduction obtained by composing independently obtained picture qualities can be obtained. Accordingly, with the alleviation of the toner retransfer problem, the gradation and general quality of the reproduction is greatly enhanced. Additionally, since the real composite print density obtained by use of the present method closely matches a calculated composite print density based upon a summation of print densities of each component of the image reproduction, adjustments to the print densities of each component may be easily made in order to make any desired print density adjustments to the final reproduction copy.

It will be apparent to those skilled in the art that various modifications and variations can be made in the method and apparatus of the present invention without departing from the scope or spirit of the invention. Thus, it is intended that the present invention cover the modifications and variations of this invention provided they come within the scope of the appended claims and their equivalents.

What is claimed is:

1. A method of making an electrophotographic reproduction copy of an original document comprising the steps of:

forming a first image with latent image forming parameters made suitable for higher print density portion reproduction;

transferring said first image onto paper;

forming a second image with latent image forming parameters made suitable for lower print density portion reproduction; and transferring said second image onto said paper so that said second image is superimposed over said first image.

2. A method of making a color electrophotographic reproduction copy of an original color document comprising the steps of:

forming a first image with latent image forming parameters made suitable for higher print density portion reproduction of a first color component of said original color document and transferring said first image onto paper;

forming a second image with latent image forming parameters made suitable for lower print density portion reproduction of said first color component and transferring said second image onto said paper so that said second image is superimposed over said first image;

forming a third image with latent image forming parameters made suitable for higher print density portion reproduction of a second color component of said original color document and transferring said third image onto said paper so that said third image is superimposed over said second image;

forming a fourth image with latent image forming parameters made suitable for lower print density portion reproduction of said second color component and transferring said fourth image onto said paper so that said fourth image is superimposed over said third image;

forming a fifth image with latent image forming parameters made suitable for higher print density portion reproduction of a third and last color component of said original color document and transferring said fifth image onto said paper so that said fifth image is superimposed over said fourth image;

forming a sixth and last image with latent image forming parameters made suitable for lower print density portion reproduction of said third and last color component and transferring said sixth and last image onto said paper so that said sixth image is superimposed over said fifth image.

3. A method of making a color electrophotographic reproduction copy of an original color document comprising the steps of:

forming a first image with latent image forming parameters made suitable for higher print density portion reproduction of a first color component of said original color document and transferring said first image onto paper;

forming a second image with latent image forming parameters made suitable for higher print density portion reproduction of a second color component of said original color document and transferring said second image onto said paper so that said second image is superimposed over said first image;

forming a third image with latent image forming parameters made suitable for higher print density portion reproduction of a third and last color component of said original color document and transferring said third image onto said paper so that said third image is superimposed over said second image;

forming a fourth image with latent image forming parameters made suitable for lower print density portion reproduction of said first color component and transferring said fourth image onto said paper so that said fourth image is superimposed over said third image;

forming a fifth image with latent image forming parameters made suitable for lower print density portion reproduction of said second color component and transferring said fifth image onto said paper so that said fifth image is superimposed over said fourth image;

forming a sixth and last image with latent image forming parameters made suitable for lower print density portion reproduction of said third and last color component and transferring said sixth and last image onto said paper so that said sixth image is superimposed over said fifth image.

* * * * *